United States Patent [19]

Busse

[11] 4,141,108

[45] Feb. 27, 1979

[54] CABINET FITTING

[75] Inventor: Peter Busse, Vlotho, Fed. Rep. of Germany

[73] Assignee: Firma Richard Heinze, Fed. Rep. of Germany

[21] Appl. No.: 800,315

[22] Filed: May 25, 1977

[30] Foreign Application Priority Data

Jun. 4, 1976 [DE] Fed. Rep. of Germany ..... 2625181

[51] Int. Cl.[2] ..... E05D 7/04; E05D 5/02

[52] U.S. Cl. ..... 16/129; 85/74; 85/75; 248/73; 248/222.4; 248/223.1; 248/224.2

[58] Field of Search ..... 16/129–134, 16/159; 248/222.4, 223.1, 73, 224.2; 403/408, 297; 85/74, 75, 77, 78

[56] References Cited

U.S. PATENT DOCUMENTS

| | | | |
|---|---|---|---|
| 612,316 | 10/1898 | Downes | 85/74 |
| 1,276,708 | 8/1918 | Bair | 85/75 |
| 2,152,871 | 4/1939 | Charland | 248/73 |
| 2,803,352 | 8/1957 | Smola et al. | 248/223.1 |
| 3,908,226 | 9/1975 | Read et al. | 16/130 |

FOREIGN PATENT DOCUMENTS

| | | | |
|---|---|---|---|
| 270439 | 4/1969 | Austria | 16/159 |
| 2025645 | 12/1971 | Fed. Rep. of Germany | 16/129 |
| 2357715 | 6/1975 | Fed. Rep. of Germany | 16/131 |
| 1555324 | 12/1968 | France | 16/159 |
| 347729 | 8/1960 | Switzerland | 85/74 |
| 1438758 | 6/1976 | United Kingdom | 248/73 |
| 1454945 | 11/1976 | United Kingdom | 85/77 |

*Primary Examiner*—James Kee Chi
*Attorney, Agent, or Firm*—Jacobs & Jacobs

[57] ABSTRACT

The present invention relates to a fitting for cabinets, and in particular to a base or adjustment plate for the adjustable mounting of a hinge arm of a cabinet hinge. The fitting part consists of at least one expandable fastening element which engages into a first borehole in a cabinet part and to which the fitting part on the cabinet part can be fastened, the fastening element being expandable by an expansion element by moving the fitting part relative to the fastening element.

12 Claims, 18 Drawing Figures

A (I–I)

CABINET FITTING

This invention relates to a fitting part for cabinets which can be fastened to the cabinet part by at least one expandable fastening element which engages into a first borehole of a cabinet part, the fastening element being adapted to be expanded by an expansion element.

In the furniture industry, numerous types of fitting parts are used, which serve, for instance, for fastening cabinet hinges, for connecting cabinet parts or cabinet walls to each other, for holding cabinet bottoms or shelves, etc., and which are intended to be fastened to at least one cabinet part.

Thus, for instance, there are known flat fitting parts which serve as base or adjustment plates for cabinet hinges, said parts serving for the adjustable attachment of hinge arms to, for instance, the side wall of a cabinet, said fitting parts or base or adjustment plates being gripped by the hinge arms insofar as the latter are of U-shaped cross section, and the arms of the U-shaped hinge arms resting against the long sides of the flat fitting parts or base or adjustment plates and thereby producing a non-twisting connection between the corresponding base or adjustment plate and the related hinge arm.

The fastening of fitting parts is effected here by screws engaged in the material of a cabinet part or by drive pins or dowels formed on the fitting part which engage into previously prepared boreholes in the cabinet part or side wall, embodiments also being known in which the fitting part itself is developed in cup shape and is adapted to be anchored in a borehole provided in a cabinet part. This last mentioned embodiment is possible, however, only in certain special cases, and normally recourse must be had to the first mentioned type of attachment by screws or by drive pins or dowels.

The previous attachment of fitting parts to cabinet parts is very time consuming and expensive in labor and therefore entirely unsatisfactory for purposes of streamlined manufacture of cabinets.

The object of the present invention is to avoid these disadvantages and to provide a fitting part of the aforementioned type which permits a simple attachment to a cabinet part and can, if necessary, be removed from said cabinet part without any difficulty.

In order to achieve this object, a fitting part of the aforementioned type is developed in accordance with the invention in such a manner that the fastening element can be expanded by a displacement of the fitting part relative to the fastening element.

The fastening element is preferably formed, in the case of the fitting part of the invention, by an expansion dowel which can be expanded by an expansion bolt which serves as expansion element and is arranged within the expansion dowel and preferably has an expansion cone at one end.

In one preferred embodiment of the invention the expansion element or the expansion bolt is provided with a shoulder which is preferably formed by a thickened head end and then engages behind at least one surface which is developed as an oblique plane so that the expansion element or bolt is partially pulled out of the fastening element by the surface developed as oblique plane upon the displacement of the fitting part relative to the fastening element or expansion dowel, thereby effecting an expansion of the fastening element or expansion dowel at the end facing away from the fitting part.

Despite its simple and economic manufacture, the fitting part of the invention can be mounted with great strength in a simple and convenient manner on a part or side wall of a cabinet.

In accordance with one modification of the invention, a lateral extension is formed on the fitting part, said extension having at its end a borehole for a fastening screw which engages into the material of the cabinet part, or else a pin developed on it which engages into a preformed borehole in said cabinet part. In this way, on the one hand, when only a single fastening element or expansion dowel is used a non-twisting attachment of the fitting part is obtained, while, on the other hand, the fitting part cannot become loose from its anchoring by unintentional displacement relative to the cabinet wall.

The fitting part in accordance with the invention is particularly well-suited also for use with or attachment to a series of holes preformed on a cabinet part or side wall, said holes serving at the same time for the attachment of shelf holders, in which case the space between the expanded fastening element and the said pin or the said borehole on the extension corresponds to the distance between the boreholes of said series of holes or to a multiple of said distance.

The fitting part in accordance with the invention is preferably developed as a plate and serves, for instance, as base or adjustment plate for the attachment of a hinge arm of a cabinet hinge.

Further developments of the invention are described in the subordinate claims.

The invention will be described below with reference to the drawing in connection will illustrative embodiments which show fitting parts in accordance with the invention in the form of base or adjustment plates. In the drawing.

Figure 9B:
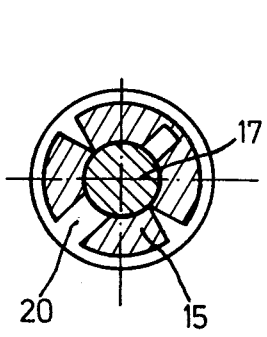
Figure 9A:
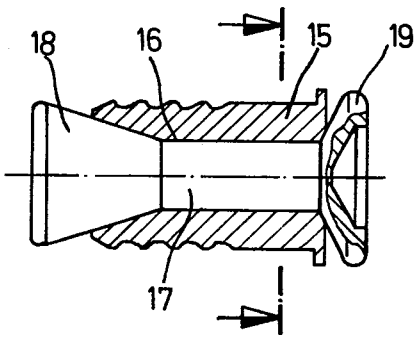
Figure 8:
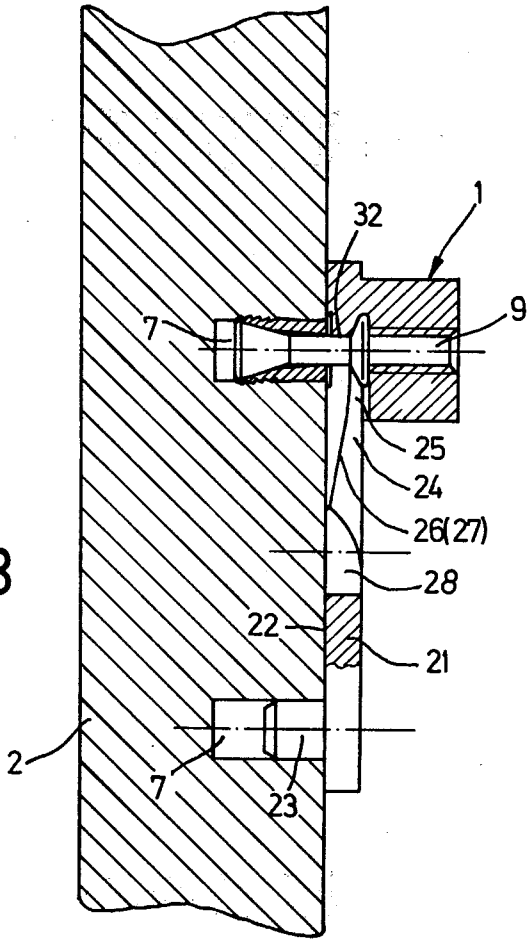
Figure 11:
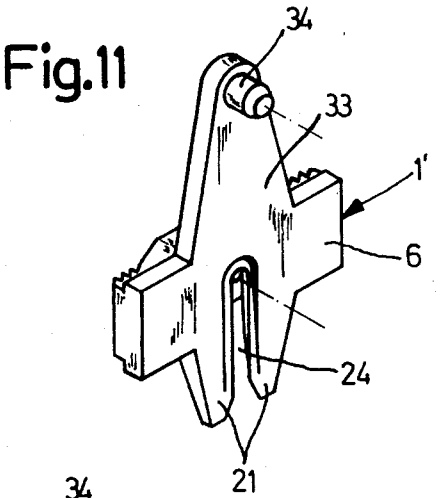
Figure 12:
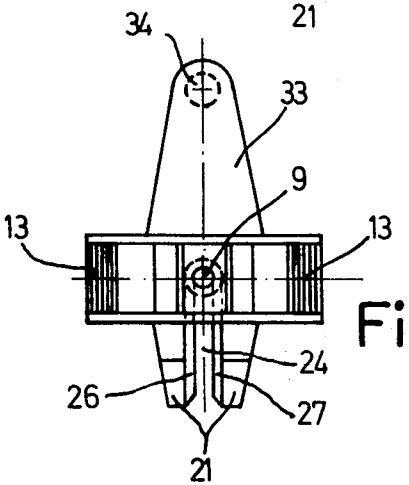
Figure 10:
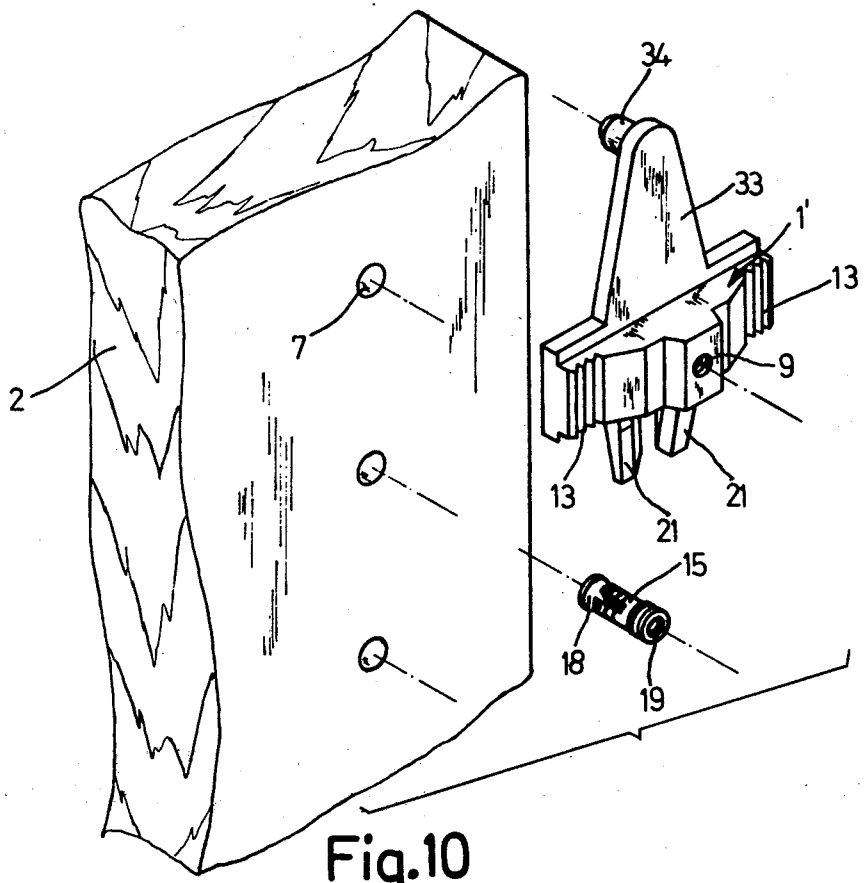
Figure 13:
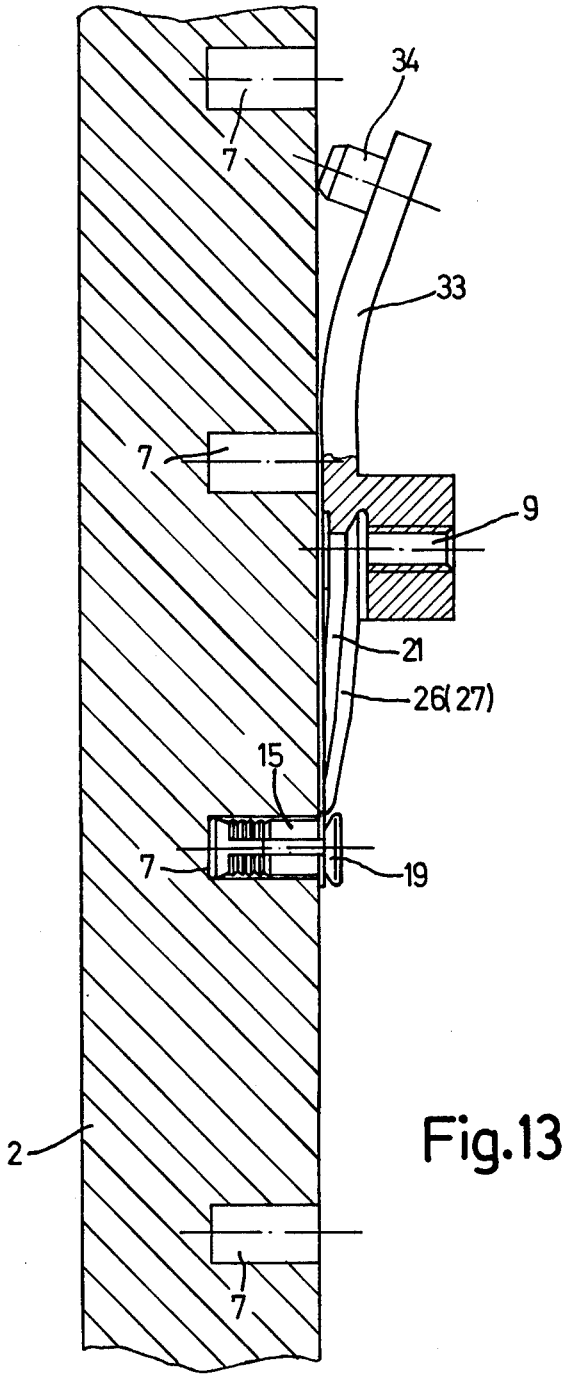
Figure 14:
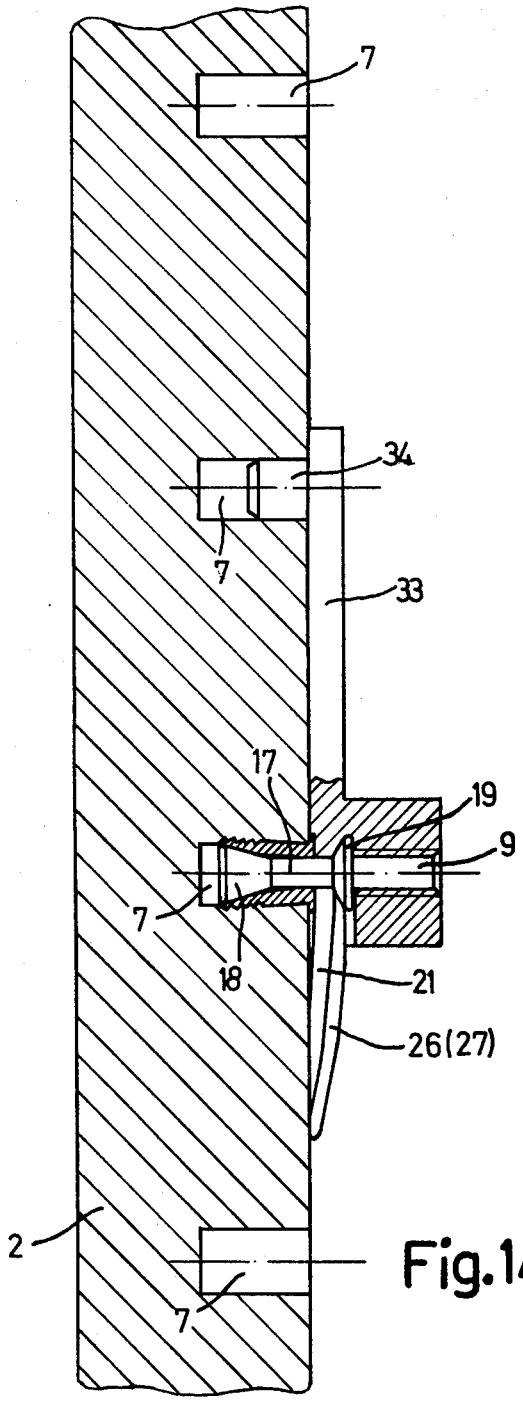
Figures 15, 16:
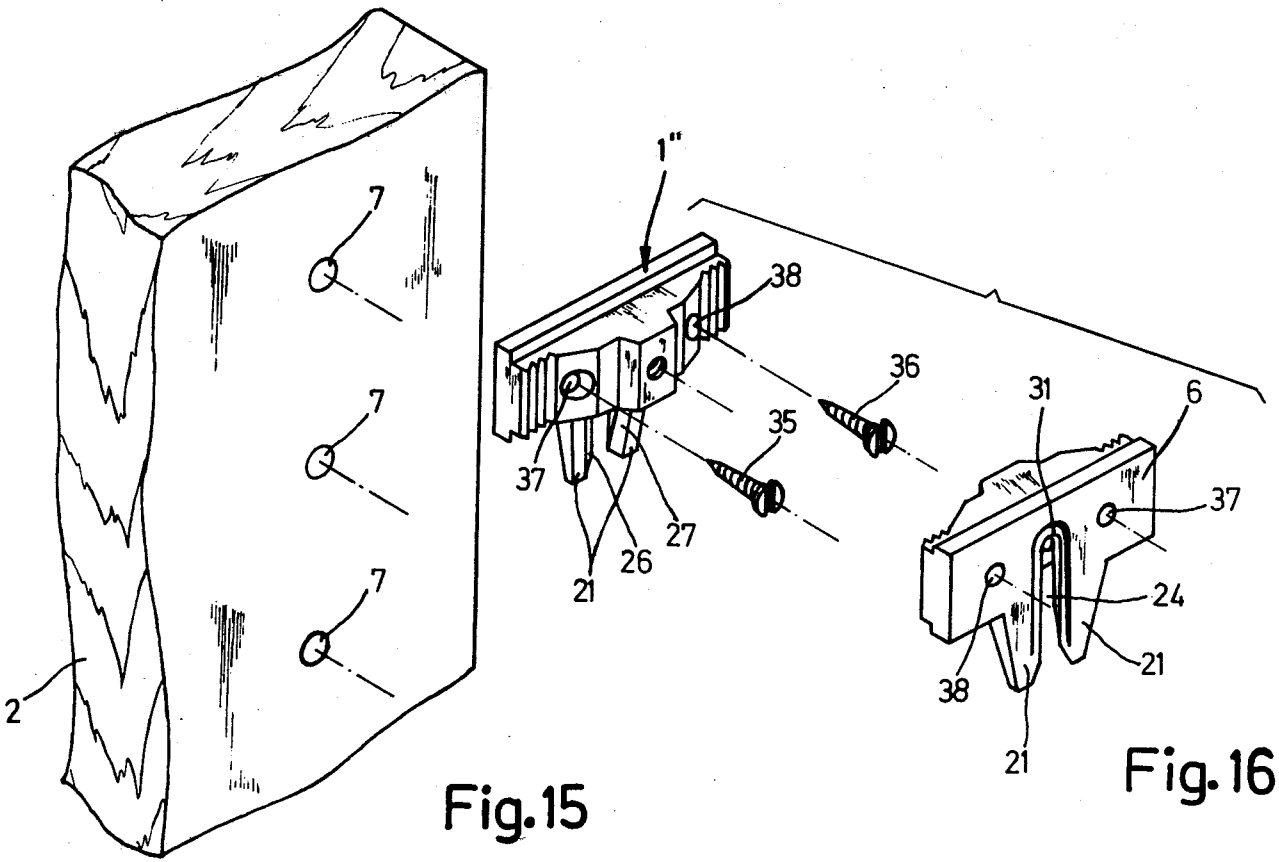
Figure 17:
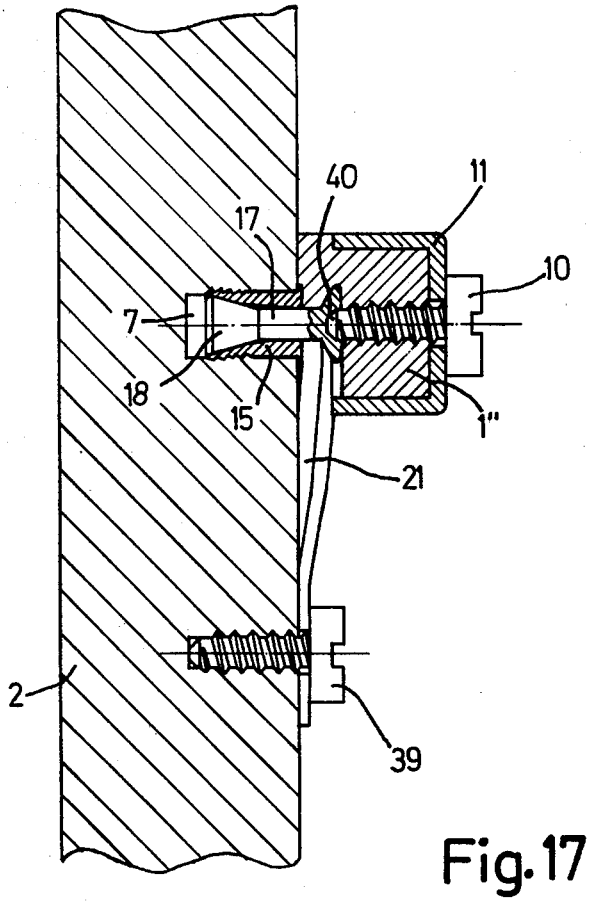

FIGS. 9*a* and 9*b* are a longitudinal section and a cross section respectively through the expansion dowel;

FIG. 10 shows, in an exploded perspective view, a second embodiment of the base or adjustment plate of the invention, together with the expansion dowel and the side wall of the cabinet;

FIGS. 11 and 12 show the base or adjustment plate of FIG. 10 in rear view and in plan view respectively;

FIGS. 13 and 14 are a section through the side wall of the cabinet and through the base or adjustment plate of FIG. 10, shown in different phases of its attachment to the side wall of the cabinet;

FIG. 15 shows in an exploded perspective view, a third embodiment of the base or adjustment plate of the invention, together with a cabinet side wall;

FIG. 16 shows the base or adjustment plate of FIG. 15, seen from the rear;

FIG. 17 is a section through the side wall of the cabinet and through the base or adjustment plate of FIG. 15 mounted on said cabinet side wall.

The base plate 1 shown in FIGS. 1 to 8 serves for the preferably adjustable mounting of a fitting part 11 of U-shaped cross section to a cabinet side wall 2, and for this purpose it has a rectangular cross section in the direction parallel to the surface sides of the cabinet side wall 2 and its two long sides 3, when the fitting part is attached, are gripped in non-twistable fashion in known manner by the arms of the fitting part. On each of its long sides the adjustment plate 1 has a laterally protruding rim 4 whose width corresponds approximately to the thickness of the arm of the fitting part, so that when the fitting part is placed on the adjustment plate 1 a smooth outer surface is obtained for the adjustment-plate/fitting-part combination.

Figures 1, 2, 3:
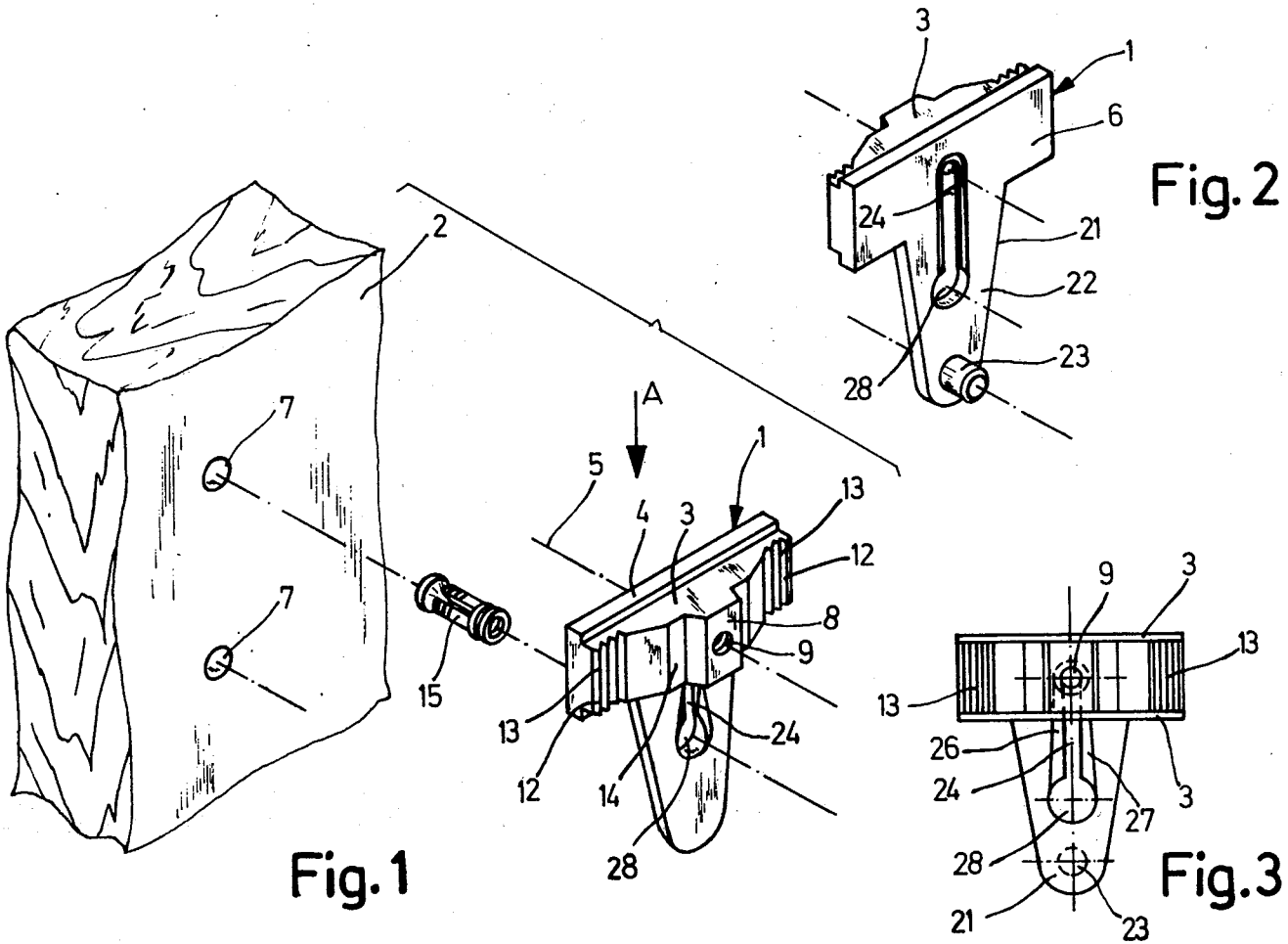
FIG. 1 is a perspective exploded view of a first embodiment of the base or adjustment plate of the invention, together with the expansion dowel and the side wall of a cabinet.
FIGS. 2 and 3 show the base or adjustment plate of FIG. 1 in rear view and in plan view respectively.

As furthermore shown by the figures, the adjustment plate 1, starting from the central line 5 which extends perpendicular to the rear side 6 or surface side facing the cabinet side wall 2, is developed symmetrically towards both ends so that the adjustment plate 1 can be fastened to the side wall 2 of the cabinet both in the position shown in FIG. 1 and also in a position turned 180° around the center line 5, whereby the mounting of the adjustment plate 1 on the side wall 2 of the cabinet is considerably simplified, since with preformed boreholes 7 in the side wall 2 of the cabinet an aligned installation of the adjustment plate 1 is assured in all cases, without any particular attention being required upon the mounting. This is advantageous, for instance, when the adjustment plate 1 is fastened by machine to the side wall 2 of the cabinet. No additional expensive technical devices are required here, such as were previously necessary in the case of asymmetrically developed adjustment plates in order to make certain that these adjustment plates mantained a given position. The symmetrical development of the adjustment plate 1 leads to a simpler and much less complicated construction of the processing machines, which makes them inexpensive, simpler to handle and operate and, of course, less subject to breakdown.

The symmetrical construction of this adjustment plate has considerable advantages even for the manual mounting of the adjustment plate, since the installer can install the adjustment plate 1 in the position in which it comes into his hands, i.e., he need not pay any particular attention to the position of installation. This has the result that even unskilled workers can be used for this installation and that the mounting is substantially simplified, even for a layman who wishes to assemble a cabinet himself.

As shown in the figures, the adjustment plate 1 is developed on the side facing away from the cabinet side wall 2 in a step-shaped manner, with a plurality of surfaces which are at a different distance from the surface side 6. The central surface 8 which is at the greatest distance from the surface side 6 is provided with a threaded borehole 9, the axis of which coincides with the center line 5, and which serves for the screwing-in of a fastening screw 10 by which the fitting part 11 of the cabinet hinge can be fastened to the adjustment plate 1 (FIG. 17).

Those surfaces 12 provided on the outer ends of the adjustment plate 1 which are the closest to the surface side 6 are each provided with a detent toothing 13 which toothings, when the fitting part 11 is fastened, cooperate with an edge of the fitting part 11 on the end of said fitting part extending furthest into the inside of the cabinet and, when the fastening screw 10 is tightened, prevent displacement of the fitting part 11 relative to the adjustment plate 1.

Between the surface 8 and the surface 12 there is provided in each case on both sides of the center line 5 another surface 14 which serves, for instance, as resting surface for a prop screw (not shown in detail) provided on the fitting part 11 by means of which the spacing of the fitting part 11 in the direction perpendicular to the surface sides of the cabinet side wall 1 is adjustable.

For the fastening of the adjustment plate 1 there is provided an expansion dowel 15 in whose longitudinal borehole 16 an expansion bolt 17 is displaceably arranged. The expansion bolt 17 is integral, at its one end, with an expansion cone 18 and, at its other end, with a head part 19 of increased cross section, and can be introduced from the side, into the longitudinal bore 16 through a laterally open slot 20 extending up into the longitudinal bore 16, with a certain amount of deformation of the expansion dowel 15 which is made of elastic material, so that the expansion bolt 17 assumes the position within the expansion dowel 15 which is shown in FIGS. 9*a* and 9*b*. On one of the long sides 3 there is formed an extension 21 which extends laterally away from the adjustment plate and the surface side 22 of which that faces the side wall 2 of the cabinet forms a continuation of the surface side 6 and has a protruding pin 23 on the end of the extension 21 facing away from the adjustment plate 1. On the surface sides 6 and 22 there is provided a slot 24 which extends perpendicularly to the long side 3 and through the extension 21 and is introduced, in the region of a recess 25, to approximately the center of the adjustment plate 1. The recess 25, which is open for this purpose on the long side 3 of the baseplate 1 adjacent the extension 21, extends in direction parallel to the surface side 6 and has a rectangular cross section.

Figures 4, 5:
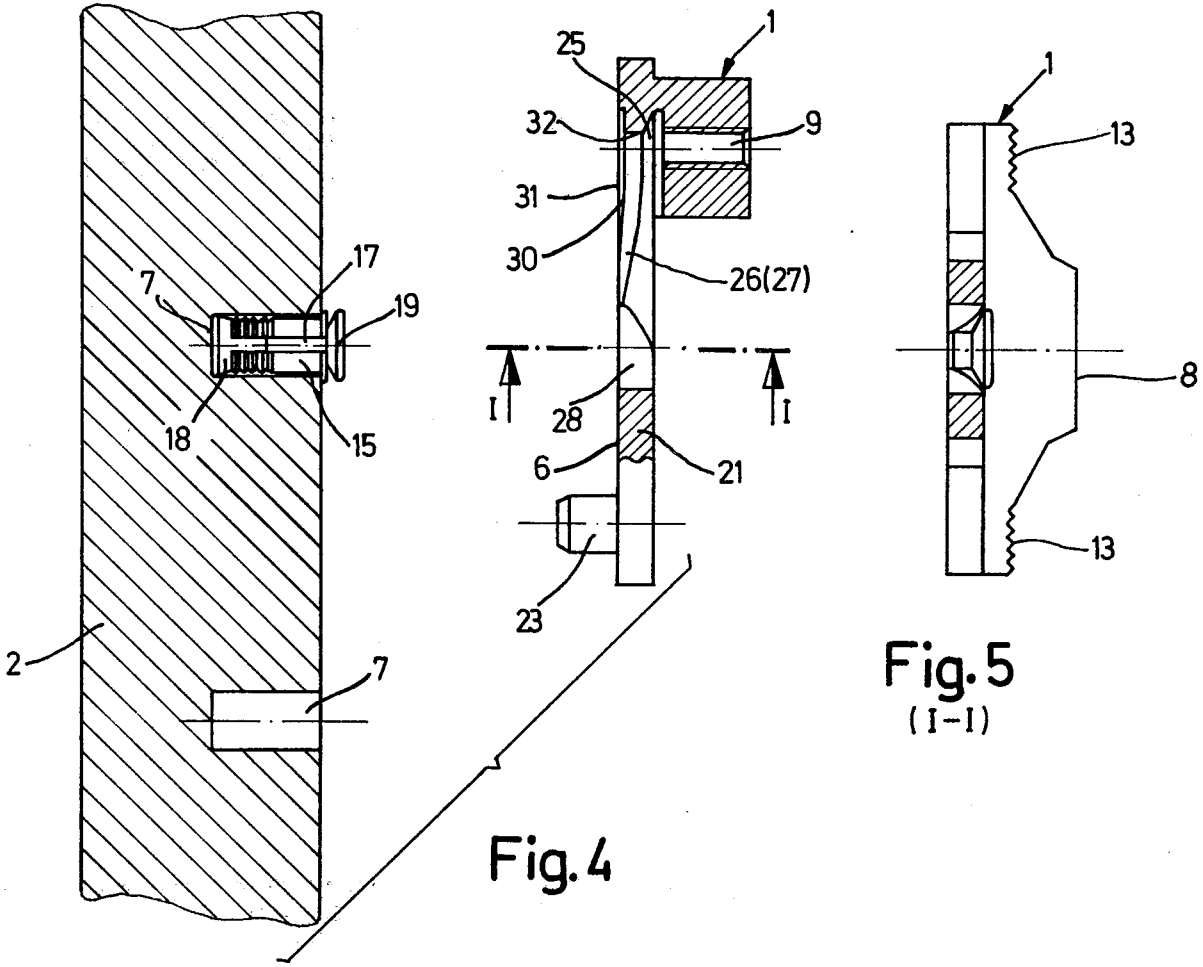
FIG. 4 is a section through the side wall of the cabinet and through the base or adjustment plate shown in FIG. 1.
FIG. 5 is a section along the line I—I of FIG. 4.
Figure 7:
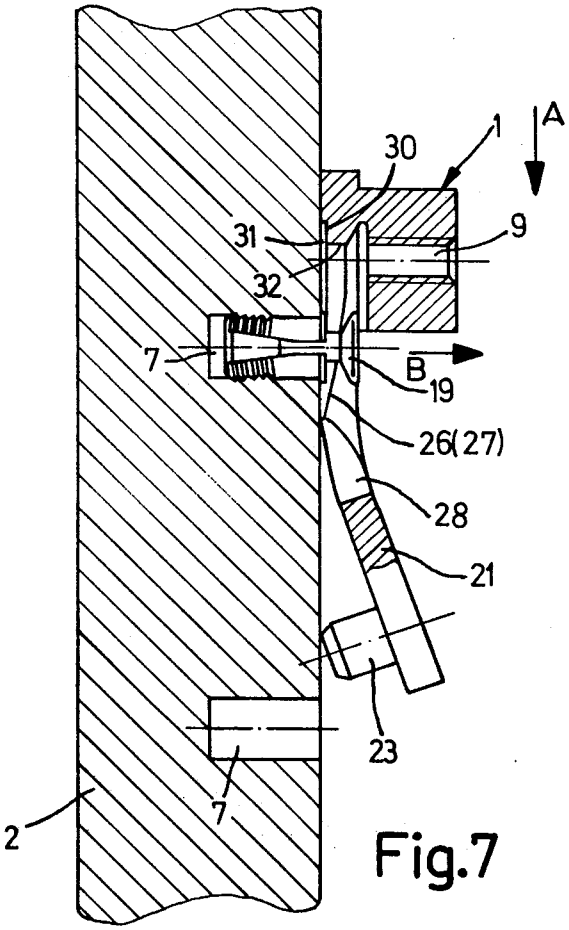
FIGS. 6 to 8 are a section through the side wall of the cabinet and through the base or adjustment plate of FIG. 1, during different phases of the attachment to the side wall of the cabinet.

As shown in particular in FIG. 4, the edge of the slot 20 facing away from the surface side 6 or the surface side 22 has two surfaces 26 and 27 which are developed as oblique planes and extend parallel to each other, their distance from the surface side 6 continuously increasing from the extension 21 to the center of the adjustment plate 1, the slot 20, whose width is equal to or slightly greater than the cross section of the expansion bolt 17, but in any event smaller than the cross section of the head part 19, discharging into a borehole 28 whose diameter is equal to or greater than the cross section of the head part 19.

Figure 6:
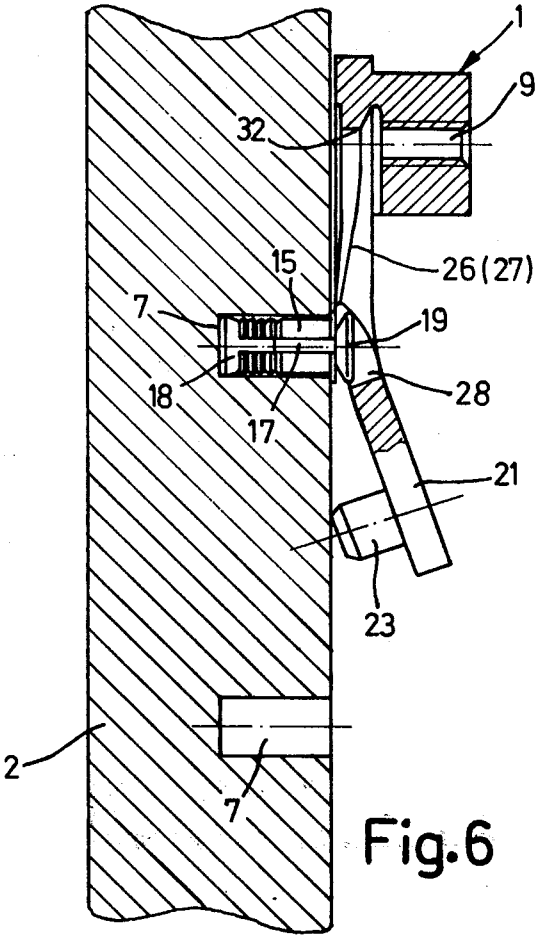

For the fastening of the adjustment plate 1 to the cabinet side walls 2, the expansion dowel 15, together with the expansion bolt 17 arranged in said expansion dowel, is first of all introduced, the expansion cone 18 first, into one of the boreholes 7 of the cabinet side wall 2 (into the upper borehole 7 in the showing selected in FIG. 1), the thickened head part 19 protruding beyond the surface side of the cabinet side wall 2. The adjustment plate 1 is now so placed on the cabinet side wall 2 that the head part 19 comes to lie in the borehole 28, the extension 21 which consists of elastic material being bent away from the side wall 2 of the cabinet by the pin 23 whose free end rests against the surface side of the cabinet side wall 2, as is shown in FIG. 6. Thereupon, the adjustment plate 1 is pushed in the direction indicated by the arrow A (FIG. 7), as a result of which the head part 19 slides on the surfaces 26 and 27 and the expansion bolt 17 is pulled out to an increasing extent in the direction indicated by the arrow B from the borehole 7 with expansion of the end of the expansion dowel 15 provided with the barbed profile, i.e. the edge regions of the adjustment plate 1 which adjoin the slot are pushed in wedge form between the head part 19 and the end of the expansion dowel 15 which faces the adjustment plate 1. This end of the expansion dowel 15 lies against the bottom surface of a recess 31 which is provided on the surface sides 6 and 22 and extends parallel to the slot 2, the width of said recess being equal to or greater than the diameter of the expansion dowel 15 and its bottom surface 30 being at an increasing distance, in the direction from the extension 21 to the center of the adjustment plate 1, from the surface side 6 or the cabinet side wall 2, as a result of which, simultaneously with the expansion of the expansion dowel 15, the adjustment plate 1 or the surface side 6 is pressed firmly against the cabinet side wall 2. The expansion of the expansion dowel 15 is complete when the end 32 of the slot 24 which is present within the adjustment plate 1 lies against the expansion bolt 17, the pin 23, when said end position is reached, snapping into the adjacent borehole 7 of the cabinet side wall so that the parts assume the position shown in FIG. 8.

The pin 23, which extends into the borehole 7 of the cabinet side wall 2, prevents an undesired pushing back of the adjustment plate 1 in the direction opposite that indicated by arrow A and thus an undesired loosening of the adjustment plate on the cabinet side wall 2; furthermore, the pin which engages into the borehole 7 also serves to assure the twist-proof fastening of the adjustment plate 1 to the cabinet side wall 2. The embodiment shown in FIGS. 10 to 14 differs from the embodiment of FIGS. 1 to 9 essentially by the fact that laterally protruding extensions 21 and 23 are developed on the two long sides respectively of the adjustment plate 1', the pin 23 being dispensed with in the case of the extension 21 which is provided with the slot for the expansion bolt 17, and the extension 33 bearing a corresponding pin 34. Furthermore, in the embodiment shown in FIGS. 10 to 14, the slot 24 is open laterally at the end of the extension remote from the adjustment plate 1' so that the expansion bolt 17 can be introduced from said open end into the slot 24.

The fastening of the adjustment plate 1' to the cabinet side wall is effected in the manner that after the insertion of the expansion dowel 15 into a corresponding borehole 7 of the cabinet side wall 2, the expansion bolt 17 is introduced into the slot 24 by moving the adjustment plate 1' in the direction indicated by the arrow C, as a result of which (? due to) the sliding of the head part 19 on the surfaces 26 and 27, the expanding of the expansion dowel 15 again takes place in the manner described above. The parts have reached their final position when the pin developed on the extension 33 has snapped, in accordance with FIG. 14, into an adjacent borehole 7 of the cabinet side wall 2.

In FIGS. 15 and 16 there is shown an adjustment plate 1" the development of which corresponds to that of the adjustment plate 1', but each of the additional extensions 33 has been dispensed with. In order to secure the adjustment plate 1" against loosening by displacement after the expansion of the expansion dowel 15, additional fastening screws 35 and 36 are provided in this embodiment, said screws being screwed through boreholes 37 and 38 of the adjustment plate 1" into the material of the side wall of the cabinet.

FIG. 17 shows a modification of the adjustment plate 1" in the manner that, in order that the expansion connection between adjustment plate 1" and cabinet side wall 2 may be secured against turning and prevented from becoming loose by unintentional displacement of adjustment plate 1", a borehole is provided on the extension 21 for a fastening screw 39 which engages into the material of the cabinet side wall 2. The securing or locking of the adjustment plate 1" against undesired displacement relative to the cabinet side wall 2 can however also be obtained by having the fastening screw 10 for the fitting part 11 engage, in screwed-in condition, into a depression 40 in the head part 9 of the expansion bolt 17, so that lateral displacement of the adjustment plate 1" relative to the expansion dowel 15 is thereby no longer possible.

What is claimed is:

1. A furniture fitting capable of being attached to a furniture surface through engagement of a bore hole in the furniture surface, said fitting comprising:

(a) an expansion dowel having an expandable portion and a displaceble head, said expandable portion having dimensions such as to permit insertion in unexpanded state in said bore hole and being expanded by displacement of said head, and (b) a fitting plate having a slotted face complementing said furniture surface, said slot being defined in said plate by internal edge portions having surfaces sloping obliquely from the face of said plate, said edge portions being operable to engage said displaceable head and, upon movement of said plate along said furniture surface, to displace said head relative to said expandable portion, and thereby expand said portion, as said head follows said sloping plate edge portions.

2. A furniture fitting according to claim 1 wherein the expansion dowel comprises a bolt having central portion and first and second end portions, said first end portion defining a conical section of increasing diameter, and said second end portion defining said head, said expansion dowel further comprising a deformable expansion member disposed about said central portion.

3. A furniture fitting according to claim 2 wherein said head is of a diameter greater than the remainder of said expansion dowel and defines a surface engageable by the internal edge portions of said plate.

4. A furniture fitting according to claim 1 wherein complementing upper inclines are defined on each of said internal edge portions of said fitting plate along the length of said slot, said inclines lying in a plane transverse to and rising obliquely from the face of the fitting plate complementing the furniture surface.

5. A furniture fitting according to claim 4 wherein said slot terminates in a recess within said fitting plate, said recess being operable to receive the head of said expansion dowel when maximumally displaced from said expandable portion.

6. A furniture fitting according to claim 5 including means operable to lock said head when disposed in said recess.

7. A furniture fitting according to claim 5 wherein said fitting plate includes a main body and a lateral extension thereof, said main body and extension having coplanar surfaces forming said face and complementing the furniture surface, said recess being disposed in said main body with said slot being defined at least in said extension and terminating in said recess, said slot further having an enlargement opposite said recess operable to receive said expansion dowel head for engagement by said slot.

8. A furniture fitting according to claim 7 wherein said fitting plate includes secondary engagement means operable to further engage said furniture surface.

9. A furniture fitting according to claim 8 wherein said fitting plate extension is elastically deformable and provided with a pin on its coplanar surface, said pin being operable to engage a second bore hole in the furniture surface.

10. A furniture fitting according to claim 8 wherein said secondary engagement means are on said fitting plate extension and comprises means receptive to a threaded fastener.

11. A furniture fitting according to claim 4 wherein the face of said fitting plate complementing the furniture surface is provided with a channel about a portion of said slot, said channel having substantially parallel side walls disposed from one another at a distance equal to or greater than the diameter of the deformable expansion member and an upper wall rising obliquely from the face of said plate in the same direction as but at a lesser angle than said upper inclines.

12. A furniture fitting according to claim 4 wherein said slot opens on one edge of said fitting plate.

* * * * *